US007167170B2

(12) United States Patent
Bae et al.

(10) Patent No.: US 7,167,170 B2
(45) Date of Patent: Jan. 23, 2007

(54) ELECTRON GUN WITH A MULTI-MEDIA MONITOR

(75) Inventors: Min-cheol Bae, Suwon (KR); Jong-hoon Choi, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 562 days.

(21) Appl. No.: 10/330,339

(22) Filed: Dec. 30, 2002

(65) Prior Publication Data

US 2003/0151347 A1 Aug. 14, 2003

(30) Foreign Application Priority Data

Jan. 10, 2002 (KR) ..... 2002-1379
Jan. 17, 2002 (KR) ..... 2002-2744

(51) Int. Cl.
*G05G 5/00* (2006.01)
*H01J 31/00* (2006.01)
*H01J 29/46* (2006.01)

(52) U.S. Cl. ..... 345/211; 315/14; 313/382

(58) Field of Classification Search ..... 315/14–16, 315/382, 382.1; 313/382, 413, 414, 446; 345/211

See application file for complete search history.

(56) References Cited

U.S. PATENT DOCUMENTS 2,971,118 A * 2/1961 Burdick ..... 315/16
5,180,945 A * 1/1993 Kweon ..... 315/14
5,397,959 A * 3/1995 Takahashi et al. ..... 315/14
6,507,143 B1 * 1/2003 Wakita et al. ..... 313/414

FOREIGN PATENT DOCUMENTS

| | | | |
|---|---|---|---|
| EP | 596443 A1 * | 5/1994 | |
| JP | 55019729 A * | 2/1980 | |
| JP | 11-224618 | 8/1999 | |
| KR | 1999-8925 | 3/1999 | |
| KR | 1999-33989 | 8/1999 | |

OTHER PUBLICATIONS

Translation of Japanese application JP11-224618.*

* cited by examiner

*Primary Examiner*—Alexander Eisen
(74) *Attorney, Agent, or Firm*—Stein, McEwen & Bui, LLP

(57) ABSTRACT

An electron gun used with a multi-media monitor with a low cathode voltage and improved focusing performance. The electron gun, which includes a cathode, a control electrode, a screen electrode, and a plurality of focusing electrodes to focus and accelerate an electron beam, is designed to satisfy the condition that a value of β is greater than or equal to 0.222 or a value of k is greater than or equal to 0.11, where β=T1/D, k=T1/L, T1 denotes a thickness of the control electrode, D denotes a diameter of an electron beam aperture of the control electrode, and L denotes the distance between a beam-entering surface of the control electrode and a beam-emitting surface of the screen electrode.

14 Claims, 2 Drawing Sheets

ELECTRON GUN WITH A MULTI-MEDIA MONITOR

CROSS-REFERENCE TO RELATED APPLICATIONS

This application claims the benefit of Korean Application Nos. 2002-1379, filed Jan. 10, 2002, and 2002-2744, filed Jan. 17, 2002, in the Korean Intellectual Property Office, the disclosure of which is incorporated herein by reference.

BACKGROUND OF THE INVENTION

1. Field of the Invention

The present invention relates to an electron gun used with a cathode ray tube, and more particularly, to an electron gun used with a multi-media monitor with an improved triode.

2. Description of the Related Art

Color cathode ray tubes (CRTs) are classified into a color picture tube (CPT) to display a moving picture as in a television, or in connection with a video and a color data tube (CDT) to display text information. CPTs need a high-brightness and low-resolution whereas CDTs need a low-brightness and high-resolution.

Combined with the recent tendency for high-brightness monitors, the popularization of asymmetric digital subscriber lines (ADSLs) or cable TVs has added a television tuner or video capture function to personal computers (PCs). Accordingly, computers capable of receiving and recording TV broadcasts have been commercialized as diversified products. Such a computer monitor needs a multi-media CRT capable of simultaneously displaying still and moving pictures and text information.

To display a high-resolution output with a color CRT for a computer monitor, a high-frequency signal is used, compared to a CPT for a moving picture display. Due to difficulty applying a high drive voltage, such a high-frequency signal is generated with the application of a low drive voltage. As a result of the application of the low drive voltage, working current and brightness or luminance are reduced.

To realize a high-brightness CRT, a method of increasing a cathode current level, a method of improving electron beam utilization efficiency, or a method of improving phosphor screen luminance efficiency has been suggested. The method of increasing the cathode current level needs a high cathode drive voltage for a greater beam current. However, the application of a high cathode drive voltage to an electron gun generates saturation current due to signal trailing or spreading, thereby resulting in divergence of an electron beam.

To address these drawbacks, there is a need to design a chassis circuit having stable amplification characteristics by using reliable, high-capacity circuit parts. However, this circuit construction adds an extra cost.

As a method of increasing current density while reducing the cost of the circuit implementation, a method of reducing a cathode spot cutoff voltage during the operation of a CRT has been suggested. When the cathode spot cutoff voltage is lowered during the CRT operation, a high current response is ensured even with a low drive voltage. However, a beam loading area on the cathode and the beam size are adversely increased even in a low-current CDT mode, thereby lowering resolution.

To solve the problem of such a resolution reduction, a method of reducing the diameter of an electron beam aperture of a control electrode, which is adjacent to the cathode of the electron gun, to reduce the cross-over diameter of an electron beam in the triode and further to reduce aberration caused by a pre-focusing lens formed in the triode, has been suggested. The beam size can be reduced with this method. However, the diameter of the control electrode is substantially too small to assemble an electron gun.

To eliminate the above problems, an example of a conventional electron gun is disclosed in Japanese Laid-open Patent publication No. 1999-224618. The electron gun includes first, second, and third electrodes sequentially arranged further from the cathode and a modulation electrode between the second and third electrodes.

As another example, an electron gun with enhanced focusing characteristics at a high brightness is disclosed in U.S. Pat. No. 5,689,158, wherein a plurality of electron beam apertures are formed in both control and screen electrodes. Since each of the control and screen electrodes includes the plurality of electron beam apertures, it is difficult to assemble the electron gun. Also, an increased number of electrodes to be controlled is impractical for applications.

Korean Laid-open Utility Model Publication No.1999-033989 discloses an electron gun including three cathodes, a heater for the cathodes, and six electrodes for accelerating electrons generated from the cathodes to focus an electron beam. In the electron gun, a second electrode among the six electrodes for accelerating electrons has an insulator of a predetermined thickness on its one side and an electrode portion of a predetermined thickness on the outer side of the insulator, and a second electrode voltage is applied to the electrode portion.

Korean Laid-open Utility Model Publication No.1999-008925 discloses an example of an electron gun for a multi-media monitor. The electron gun focuses electrons emitted from several cathodes on a screen through a first electrode unit, a second electrode unit, and a main lens unit. The first electrode unit includes two electrodes and a fixing spacer between the electrodes, wherein the fixing spacer has an electron beam aperture at its center.

SUMMARY OF THE INVENTION

Accordingly, it is an aspect of the present invention to provide an electron gun used with a multi-media monitor with a low cathode drive voltage and enhanced focusing performance.

It is another aspect of the present invention to provide an electron gun used with a multi-media monitor comparable to a high-brightness, low-resolution cathode picture tube (CPT) and a high-resolution, low-brightness cathode data tube (CDT).

Additional aspects and advantages of the invention will be set forth in part in the description which follows and, in part, will be obvious from the description, or may be learned by practice of the invention.

The foregoing and/or other aspects of the present invention are achieved by providing an electron gun used with a multi-media monitor, the electron gun comprising a cathode, a control electrode, a screen electrode, and a plurality of focusing electrodes to focus and accelerate an electron beam and satisfy the condition that a value of $\beta$ is greater than or equal to 0.222, where $\beta = T1/D$, T1 denotes a thickness of the control electrode, and D denotes a diameter of an electron beam aperture of the control electrode. It is preferable that the value of β satisfies the condition that $0.222 \leqq \beta < 0.316$.

The foregoing and/or other aspects of the present invention are also achieved by providing an electron gun used with a multi-media monitor, the electron gun comprising a cathode, a control electrode, a screen electrode, and a plurality of focusing electrodes to focus and accelerate an electron beam and satisfy the condition that a value of M is greater than or equal to 0.222, where M is the quotient of dividing T1 by $DS=2\times(A/C)^{0.5}$, T1 denotes a thickness of the control electrode, A denotes an area of an electron beam aperture of the control electrode, and C denotes the circumference of the electron beam aperture of the control electrode. It is preferable that the value of M satisfies the condition that $0.222 \leqq M < 0.316$.

The foregoing and/or other aspects of the present invention may also be achieved by providing an electron gun used with a multi-media monitor, the electron gun comprising a cathode, a control electrode, a screen electrode, and a plurality of focusing electrodes to focus and accelerate an electron beam and satisfy the condition that a value of k is greater than or equal to 0.11, where k=T1/L, T1 denotes a thickness of the control electrode, and L denotes the distance between a beam-entering surface of the control electrode and a beam-emitting surface of the screen electrode. It is preferable that the value of k satisfies the condition that $0.11 \leqq k < 0.135$.

In each of the electron guns described above, a minimum diameter of the electron beam aperture of the control electrode may be in the range of 0.3–0.4 mm. Preferably, a cathode spot cutoff voltage applied to the cathode is in the range of 50–95V, and the cathode spot cutoff voltage applied to the cathode is in the range of 50–80V. Preferably, a zero voltage is applied to the control electrode, and a voltage of 400–1000V is applied to the screen electrode. In this case, a voltage of 600V is applied to the screen electrode.

BRIEF DESCRIPTION OF THE DRAWINGS

These and other objects and advantages of the invention will become apparent and more readily appreciated from the following description of the embodiments, taken in conjunction with the accompanying drawings of which.

DETAILED DESCRIPTION OF THE INVENTION

Figure 1:
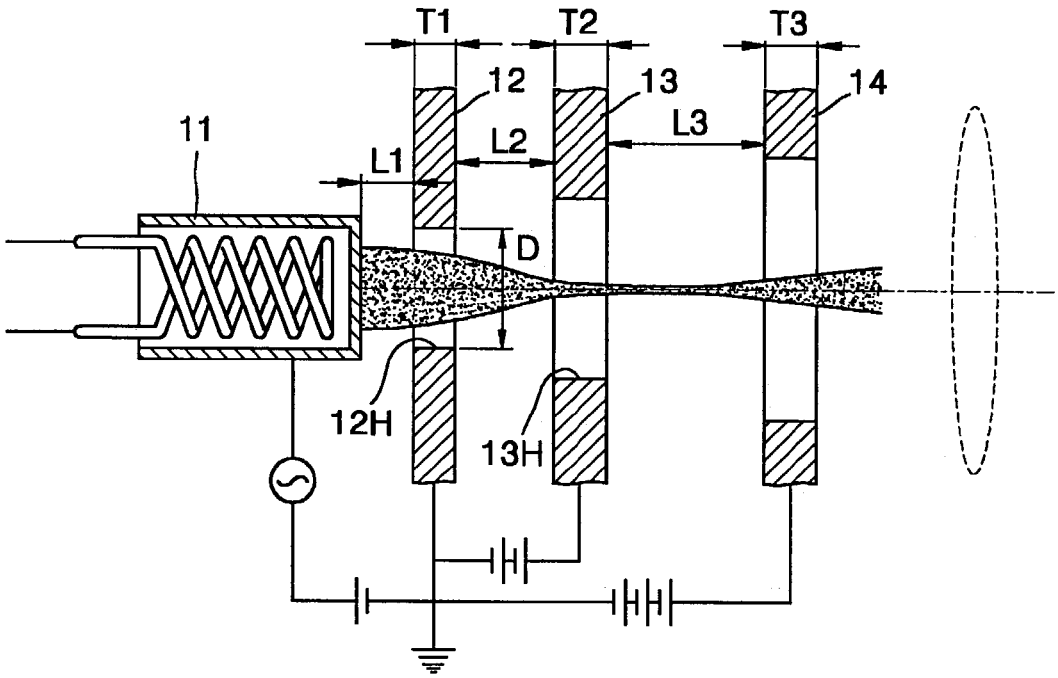
FIG. 1 is a sectional view showing a triode of an electron gun according to an embodiment of the present invention.

Reference will now be made in detail to the embodiments of the present invention, examples of which are illustrated in the accompanying drawings, wherein like reference numerals refer to like elements throughout. The embodiments are described below in order to explain the present invention by referring to the figures.

An electron gun with an improved triode according to an embodiment of the present invention is shown in FIG. 1. Referring to FIG. 1, the electron gun used with a CRT includes a cathode 11, a control electrode 12, a screen electrode 13, which comprises a triode, and a plurality of focusing electrodes (not shown) to focus and accelerate an electron beam, including a first focusing electrode 14 arranged next to the screen electrode 13.

Figure 2:
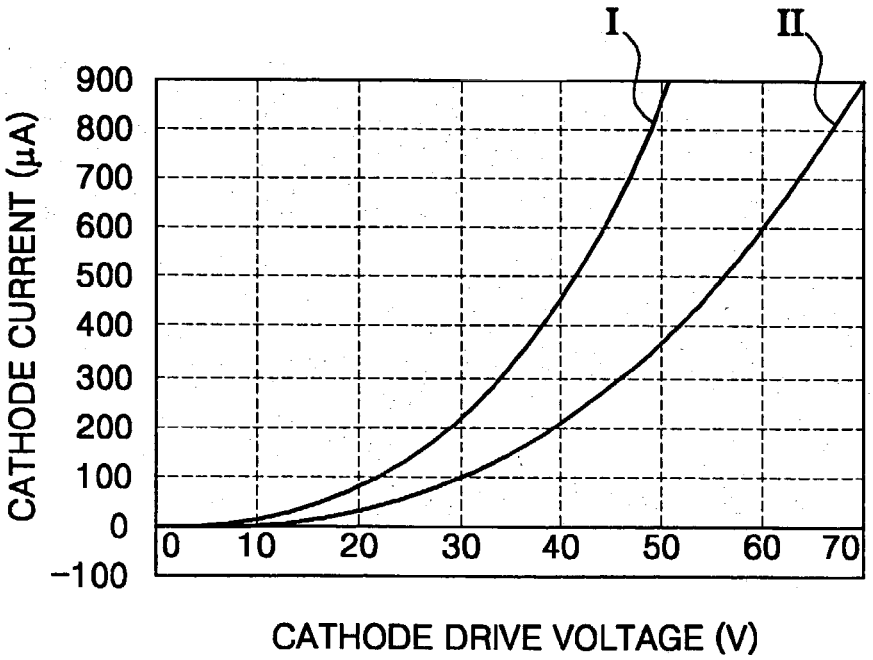
FIG. 2 is a graph of the relationship between a cathode drive voltage and cathode current applied to the electron gun shown in FIG. 1.

In such an electron gun, a cathode spot cutoff voltage applied to the cathode 11 for high brightness and high resolution is in the range of 50–95V, preferably 50–80V. This level of the cathode spot cutoff voltage is lower than a general cathode spot cutoff voltage level of 122V. FIG. 2 shows the relationship between a cathode drive voltage and a cathode current when the cathode spot cutoff voltage is lowered to this level. In FIG. 2, II denotes a case where the general cathode spot cutoff voltage of 122V is applied, and I denotes a case where a cathode spot cutoff voltage of 63V is applied. In the case of I, a cathode current value is as high as 850 μA to provide high brightness even when a drive voltage of about 50V is applied as in a cathode data tube (CDT) mode.

In the electron gun of FIG. 1, a zero voltage is applied to the control electrode 12, and a voltage of 400–1000V, preferably 600V, is applied to the screen electrode 13. To the first focusing electrode 14 adjacent to the screen electrode 13, a voltage of substantially 6–10 kV is applied.

If the cathode spot cutoff voltage is lowered as described above, the emittence of an electron beam from the triode of the electron gun may degrade by about 20–40%, and the focusing characteristics may degrade. To compensate for the problem of the focusing characteristic degradation, in an embodiment according to the present invention, a thickness of the control electrode 12 and a diameter of an electron beam aperture 12H are varied.

In particular, denoting the thickness of the control electrode 12 in millimeters as T1, the diameter of the electron beam aperture 12H of the control electrode 12 in millimeters as D, and the quotient of dividing the thickness T1 by the diameter D as β (=T1/D), the thickness T1 of the control electrode 12 and the diameter D of the electron beam aperture 12H are determined such that β is greater than or equal to 0.222 to offset the focusing characteristic degradation. Here, the diameter D of the electron beam aperture 12H is defined as the minimal distance passing through the center point-across the electron beam aperture 12H, and the thickness T1 of the control electrode 12 is defined at the electron beam aperture 21H to be minimal.

It is preferable that β is determined to be in the range of $0.222 \leqq \beta < 0.316$. In this case, the diameter D of the electron beam aperture 12H of the control electrode 12 is determined to be preferably greater than 0.3 mm, and more preferably in the range of 0.3–0.4 mm. If the diameter D of the electron beam aperture 12H of the control electrode 12 is less than 0.3 mm, there may be be inserted into the electron beam aperture 12H in the assembly of the cathode 11 and the control electrode 12. Therefore, it may be difficult to process the nozzle, thereby lowering productivity.

In addition, when the diameter D of the electron beam aperture 12H of the control electrode 12 is reduced, an area of an electron beam emitted from the surface of the cathode 11 becomes small and a load on the cathode 11 increases, thereby causing a problem of lifespan. To eliminate this problem, it is preferable to use an impregnated cathode.

In another embodiment of the present invention, when the electron beam aperture 12H of the control electrode 12 is non-circular, the value of β can be defined to be the following M. Here, a value twice the square root of the quotient of dividing the area of the electron beam aperture 12H by the circumference of the electron beam aperture 12H is used. In particular, denoting the thickness of the control electrode 12 as T1, the area of the electron beam aperture 12H of the control electrode 12 as A, and the circumference of the electron beam aperture 12H as C, that value is expressed as $2\times(A/C)^{0.5}=DS$. In addition, denoting the quotient of dividing the thickness T1 of the control electrode 12 by DS as M, the thickness T1 of the control electrode 12 and the area A of the electron beam aperture 12H are determined such that M is greater than or equal to 0.222. Preferably, M is determined to be in the range of $0.222\leqq M<0.316$.

The operation of the electron gun used with a color CRT with the improved triode according to the embodiments of the present invention described above is as follows.

When a cathode spot cutoff voltage of 50–95V, preferably 50–80V, is applied to the cathode 11 of the electron gun, and a predetermined voltage is applied to each of the electrodes constituting the electron gun, a signal voltage is applied to the cathode 11 to readily emit an electron beam toward a screen. A cathode lens (not shown) is formed between the cathode 11, the control electrode 12, and the screen electrode 13. A pre-focusing lens (not shown) is formed between the screen electrode 12 and the adjacent first focusing electrode 14, and focusing lenses to focus and accelerate the electron beam are formed between the focusing electrodes.

The electron beam emitted from the cathode 11 is pre-focused and accelerated by the cathode lens and pre-focusing lens and focused and accelerated by the focusing lenses to land on a phosphor screen (not shown). For these processes, a cathode spot cutoff voltage of 50–95V, preferably, 50–80V, which is lower than a general cathode spot cutoff voltage of 120V for a computer monitor, is applied to the cathode 11. As a result, even with a cathode drive voltage of about 50V, beam current is increased by about 2 times.

Degradation of the focusing characteristics resulting from the increased beam current can be suppressed by determining the thickness T1 of the control electrode 12 and the diameter D of the electron beam aperture 12H such that $\beta(=T1/D)$ is to be greater than or equal to 0.222. When this condition is satisfied, divergence of the electron beam is suppressed by the cathode lens, thereby reducing the diameter of a bundle of electron beams in the triode. In other words, degradation of the focusing characteristics is prevented by reducing aberration with the pre-focusing lens.

To solve the problem of degradation in the emittence of the electron beam from the triode of the electron gun and in focusing characteristics as a result of the dropping of the cathode spot cutoff voltage, as described above, in another embodiment of the present invention a thickness of the electron beam aperture 12H of the control electrode 12 is determined to be optimal. This embodiment will be described in greater detail below.

Defining a thickness of the control electrode 12 in millimeters as T1, a thickness of the screen electrode 13 in millimeters as T2, the distance between a beam-emitting surface of the control electrode 12 and a beam-entering surface of the screen electrode 13 in millimeters as L2, the distance between a beam-entering surface of the control electrode 12 and a beam-emitting surface of the screen electrode 13 as L (=T1+L2+T2), and the quotient of dividing the thickness T1 by the distance as k (=T1/L), the thicknesses of the control electrode 12 and the screen electrode 13 and the distance L between the control electrode 12 and the screen electrode 13 are determined such that k is greater than or equal to 0.11, thereby offsetting degradation of the focusing characteristics. Here, the thicknesses T1 and T2 of the control electrode 12 and the screen electrode 13 are defined at the electron beam apertures 12H and 13H, respectively, to be minimal.

Preferably, k is determined to be in the range of $0.11\leqq k<0.135$. When this condition is satisfied, a diameter D of the electron beam aperture 12H of the control electrode 12 is determined to be preferably greater than 0.3 mm, and more preferably in the range of 0.3–0.4 mm. If the diameter D of the electron beam aperture 12H of the control electrode 12 is formed to be less than 0.3 mm, there may be a need to make a diameter of a nozzle small, which is to be inserted into the electron beam aperture 12H in the assembly of the cathode 11 and the control electrode 12. Therefore, it may be difficult to process the nozzle, thereby lowering productivity. In addition, when the diameter D of the electron beam aperture 12H of the control electrode 12 is reduced, an area of an electron beam emitted from the surface of the cathode 11 becomes small and a load on the cathode 11 increases, thereby causing a problem of lifespan. To eliminate this problem, it is preferable to use an impregnated cathode, as described above.

The operation of the electron gun used with a color CRT with the improved triode according to the embodiment of the present invention described above is as follows.

When a cathode spot cutoff voltage of 50–95V, preferably 50–80V, is applied to the cathode 11 of the electron gun manufactured according to the present invention, and a predetermined voltage is applied to each of the electrodes constituting the electron gun, a signal voltage is applied to the cathode 11 to readily emit an electron beam toward a screen. A cathode lens (not shown) is formed between the cathode 11, the control electrode 12, and the screen electrode 13. A pre-focusing lens (not shown) is formed between the screen electrode 13 and the adjacent first focusing electrode 14, and focusing lenses to focus and accelerate the electron beam are formed between the focusing electrodes.

The electron beam emitted from the cathode 11 is pre-focused and accelerated by the cathode lens and pre-focusing lens and focused and accelerated by the focusing lenses to land on a phosphor screen (not shown). For these processes, a cathode spot cutoff voltage of 50–95V, preferably, 50–80V, which is lower than a general cathode spot cutoff voltage of 120V for a computer monitor, is applied to the cathode 11. As a result, even with a cathode drive voltage of about 50V, beam current is increased by about 2 times.

Degradation of the focusing characteristics resulting from the increased beam current can be suppressed by appropriately determining the thicknesses of the control electrode 12 and the screen electrode 13 and the distance between the same, such that a value of k is greater than or equal to 0.11, where k=T1/L. Here, T1 denotes the thickness of the control electrode 12 in millimeters, L (=T1+L2+T2) denotes the distance between a beam-entering surface of the control electrode 12 and a beam-emitting surface of the screen electrode 13, T2 denotes the thickness of the screen electrode 13 in millimeters, and L2 denotes the distance between a beam-emitting surface of the control electrode 12 and a beam-entering surface of the screen electrode 13. When this condition is satisfied, divergence of the electron beam is suppressed by the cathode lens, thereby reducing the diameter of a bundle of electron beams in the triode. In other words, degradation of the focusing characteristics is prevented by reducing aberration with the pre-focusing lens.

The effect of the preferred embodiments of the present invention will be more apparent by means of the following experimental examples conducted by the inventor.

EXPERIMENTAL EXAMPLE 1

In Examples 1 through 3, electron beam size was measured with different values of β (=T1/D) at a constant cathode spot cutoff voltage by changing the thickness T1 of a control electrode and the diameter D of a cathode electron beam aperture. As a comparative example, beam size was measured by changing a cathode spot cutoff voltage applied to the cathode of a triode of an electron gun used with a conventional CRT monitor. The results are shown in Table 1. Here, a screen brightness was 120 cd/m$^2$, and a cathode current was about 200 μA.

TABLE 1

| | Comparative Example | | Experimental Example 1 | | |
|---|---|---|---|---|---|
| Example | Comparative Example 1 | Comparative Example 2 | Example 1 | Example 2 | Example 3 |
| Screen Electrode Voltage (V) | 600 | 600 | 600 | 600 | 600 |
| Cathode Spot Cutoff Voltage (V) | 122 | 62 | 62 | 62 | 62 |
| Electron Beam Aperture Diameter of Control Electrode (D, μm) | 360 | 360 | 360 | 330 | 300 |
| Control Electrode Diameter (T1, mm) | 65 | 65 | 90 | 80 | 70 |
| β (= T1/D) | 0.18 | 0.18 | 0.25 | 0.24 | 0.233 |
| Electron Beam Diameter (Ik = 200 μA) | 0.43 | 0.51 | 0.406 | 0.411 | 0.417 |
| Cathode Current (Ik) with 50 V Drive Voltage | 320 | 850 | 850 | 850 | 850 |

In Comparative Example 1 and 2, an electron gun with a control electrode having a thickness of 65 μm and an electron beam aperture diameter of 360 μm was used. The cathode current was comparatively measured with the applications of the same drive voltage 50V but a cathode spot cutoff voltage of 122V for Comparative Example 1 and of 62V for Comparative Example 2. In Comparative Example 2, the cathode current level is increased to 850 μA, which is about 2.6 times higher than Comparative Example 2. In other words, although the drive voltage level is the same, better cathode response characteristics can be obtained by reducing the cathode spot cutoff voltage. However, at a cathode current of 200 μA, which is a general current level in cathode data tubes (CDTs), the electron beam diameter becomes larger for Comparative Example 2 using the lower cathode spot cutoff voltage than for Comparative Example 1. In other words, in a data display such as a computer monitor, the low cathode spot cutoff voltage may result in indistinct data display.

Therefore, there is a need to design an electron gun used with a computer monitor such that the electron beam size is maintained to be small without resolution degradation in a low-brightness data region.

In Examples 1 through 3, a screen voltage of 600V, which is a general level for common computer CRTs, and a cathode spot cutoff voltage of 62V, which is lower than a general level of 120V for common CRTs, were applied. In this state, the electron beam size on the screen was comparatively measured with different values of β (=T1/D) by changing the thickness T1 of a control electrode and the diameter D of a cathode electron beam aperture.

As shown in Table 1, the larger the value of β, the smaller the beam size on the screen. In Table 1, when the value of β is greater than or equal to 0.222, the electron beam can be focused on the screen to be small even with the low cathode spot cutoff voltage, which is small enough to satisfy the requirement for data display. Evidently, focusing performance of the electron gun can be ensured by adjusting the value of β.

As is apparent from Table 1, according to the structure of the electron guns of Examples 1 through 3 according to the present invention, an increase in the beam size at a low current region due to the dropping of the cathode spot cutoff voltage can be controlled by adjusting the ratio of the control electrode thickness to the diameter of the electron beam aperture. As a result, a powerful triode lens can be implemented, thereby ensuring good text resolution in the low-current, data region. In addition, better cathode driving characteristics can be ensured even with the same drive voltage.

EXPERIMENTAL EXAMPLE 2

A cathode spot cut off voltage of 62V was applied to the cathode of a triode of an electron gun, and a cathode current of 200 μA, which is a general level for data display, was generated to focus an electron beam on a screen. Here, the electron beam size was measured by changing the value of β, which is the quotient of dividing the thickness T1 of the control electrode by the diameter D of the electron beam aperture. The results are shown in Table 2.

TABLE 2

| T1/D (mm) | β (= T1/D) | Beam Size (mm) | Distance Between Cathode and Control Electrode (L1) |
|---|---|---|---|
| 0.12/0.36 | 0.333 | 0.369 | 0.061 |
| 0.11/0.36 | 0.316 | 0.371 | 0.070 |
| 0.09/0.36 | 0.250 | 0.377 | 0.107 |
| 0.08/0.36 | 0.222 | 0.430 | 0.123 |
| 0.07/0.36 | 0.194 | 0.452 | 0.138 |
| 0.06/0.36 | 0.167 | 0.530 | 0.095 |

When the value of β is in the range of $0.222 \leqq \beta < 0.316$, a high current can be generated with the application of the low drive voltage in a cathode data tube (CDT) mode, as in a cathode picture tube (CPT) mode. In a low-current region for data display, a small electron beam can be focused.

EXPERIMENTAL EXAMPLE 3

Electron beam size was measured with the application of a cathode spot cutoff voltage (CoEk) by changing the thicknesses of the control electrode and the screen electrode and the spacing between the control electrode and the screen electrode. The results are shown in Table 3.

TABLE 3

| | Experimental Example 3 | | | | | | | | | | | |
|---|---|---|---|---|---|---|---|---|---|---|---|---|
| | Ex. 1 | Ex. 2 | Ex. 3 | Ex. 4 | Ex. 5 | Ex. 6 | Ex. 7 | Ex. 8 | Ex. 9 | Ex. 10 | Comparative Example 3 | Comparative Example 4 |
| T1 | 0.09 | 0.09 | 0.09 | 0.09 | 0.09 | 0.09 | 0.09 | 0.09 | 0.09 | 0.09 | 0.065 | 0.065 |
| L2 | 0.265 | 0.265 | 0.265 | 0.265 | 0.255 | 0.325 | 0.255 | 0.285 | 0.245 | 0.245 | 0.255 | 0.270 |
| T2 | 0.90 | 0.77 | 0.65 | 0.54 | 0.48 | 0.40 | 0.41 | 0.40 | 0.33 | 0.30 | 0.40 | 0.40 |
| CoEk | 62 | 62 | 62 | 62 | 62 | 62 | 62 | 62 | 62 | 62 | 115 | 62 |
| Horizontal beam size | 0.366 | 0.377 | 0.376 | 0.380 | 0.382 | 0.363 | 0.395 | 0.392 | 0.413 | 0.418 | 0.402 | 0.539 |
| Vertical beam size | 1.047 | 0.865 | 0.722 | 0.594 | 0.531 | 0.537 | 0.439 | 0.373 | 0.330 | 0.293 | 0.468 | 0.484 |
| Beam Area | 0.301 | 0.256 | 0.213 | 0.177 | 0.159 | 0.153 | 0.136 | 0.115 | 0.107 | 0.096 | 0.148 | 0.205 |
| L | 1.255 | 1.120 | 1.000 | 0.895 | 0.825 | 0.815 | 0.750 | 0.690 | 0.665 | 0.635 | 0.720 | 0.735 |
| K | 0.072 | 0.080 | 0.090 | 0.100 | 0.109 | 0.110 | 0.120 | 0.130 | 0.135 | 0.142 | 0.090 | 0.088 |

As shown in Table 2, changes in the beam size on a screen were observed by varying the thickness of the control electrode with the fixed diameter of the electron beam aperture of the control electrode. When the value of β is smaller than 0.222, the beam size greatly increases.

Comparing with conventional electron guns used with CRTs, in an electron gun used with a multimedia display, the beam size needs to be maintained to be small without causing degradation of display characteristics in a data region. Therefore, the value of β needs to be greater than or equal to 0.222, as is apparent from Table 2.

As the thickness T1 of the control electrode is increased for a larger value of β, the distance L1 between the cathode and the control electrode becomes smaller.

For tolerances to an error occurring when the cathode of the electron gun is assembled into the control electrode and to a thermal deformation of the cathode, the distance L1 between the cathode 11 and the control electrode 12 needs to be maintained to be at least 70 μm. A minimum distance between the cathode 11 and the control electrode 12 should be ensured by consideration of surface depression of the cathode due to deviations in processing and the thermal deformation, electronic shorts, and white balance characteristics. When the distance L1 between the cathode 11 and the control electrode 12 is 70 μm, the value of β is 0.316 in Table 1. The value β, which is the quotient of dividing the diameter D of the electron beam aperture by the thickness T1 of the control electrode 12, must be smaller than this level.

In Table 3, T1 denotes a thickness of the control electrode, T2 denotes a thickness of the screen electrode, L2 denotes the distance between a beam-emitting surface of the control electrode and a beam-entering surface of the screen electrode 13, and L denotes the distance between a beam-entering surface of the control electrode and a beam-emitting surface of the screen electrode, which is the sum of T1, L2, and T2, all of which are in millimeters. CoEk denotes the cathode spot cutoff voltage. The beam area is calculated in $mm^2$ by multiplying horizontal beam radius by vertical beam radius and by π. k is the quotient of dividing the thickness T1 by the distance L.

In Comparative Examples 3 and 4, the beam area was calculated with the application of a cathode spot cutoff voltage of 115V and 62V, respectively, to the electron gun of a conventional CRT. The changes in the electron beam area with different values of k in Table 3 are illustrated in FIG. 3.

Figure 3:
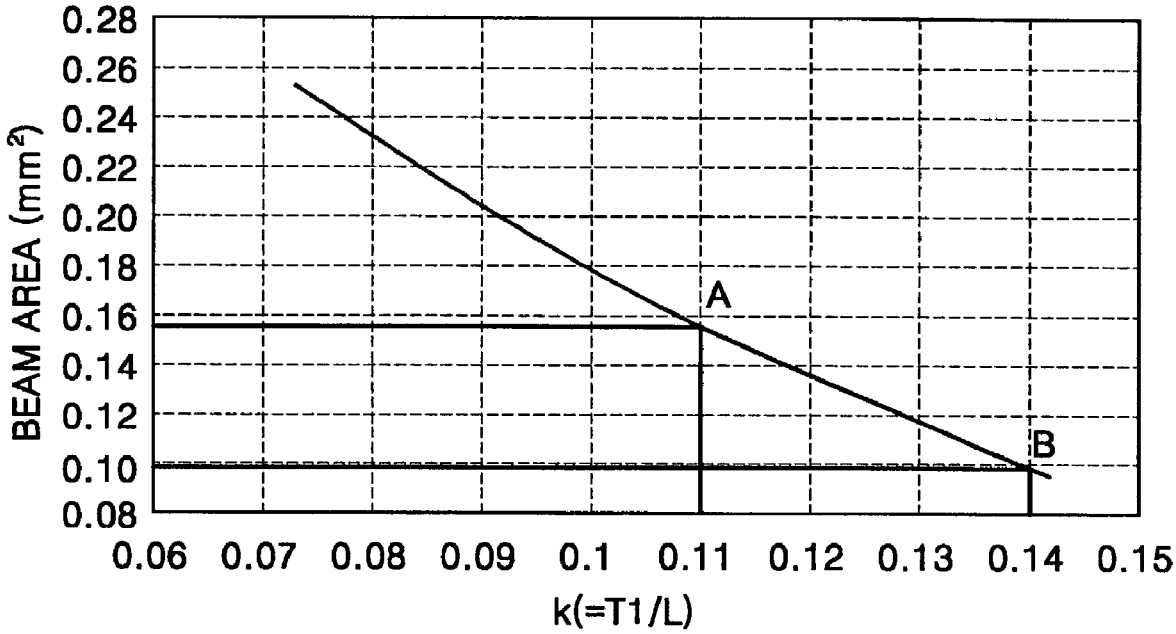
FIG. 3 is a graph of the relationship between k and beam area.

Referring to Table 3 and FIG. 3, the electron beam area is inversely proportional to the value of k. The beam area must be within a range of 105% of that when the cathode spot cutoff voltage of 115V is applied, i.e., be smaller than 0.155 $mm^2$. This beam area requirement is satisfied with k greater than or equal to 0.11, as shown in Table 1. Although the beam area can be further reduced with k greater than or equal to 0.135, the thickness T2 of the screen electrode 13 and the distance L2 between the control electrode 12 and the screen electrode 13 are reduced with the value of k, relatively with respect to the thickness T1 of the control electrode so that it is difficult to manufacture the electron gun. Furthermore, the vertical beam size is reduced to 0.33 mm or less, which is much smaller than the horizontal beam size, thereby causing another problem such as a Moire phenomenon to occur. Therefore, if the value of k is determined to be in the range of $0.11 \leqq k < 0.135$, a high current can be generated with the application of a low drive voltage as in a CPT mode. Simultaneously, good focusing characteristics can be attained even with a low current level.

As is apparent from Table 3 and FIG. 3, according to the structure of the electron guns according to the embodiments of the present invention, an increase in the beam size at a low-current region due to the dropping of the cathode spot cutoff voltage can be controlled by adjusting the value of k. As a result, a powerful triode lens can be implemented, thereby ensuring good text resolution in the low-current, data region. In addition, better cathode driving characteristics can be ensured even with the same drive voltage.

An electron gun used with a multi-media monitor according to the embodiment of the present invention, as described above, provides the following effects. First, by limiting the thickness of the control electrode and the diameter of the electron beam aperture of the control electrode with the application of a low cathode spot cutoff voltage to the cathode of a triode, the quantity of current can be increased about twice with a drive voltage of 50V. Second, the size of an electron beam spot can be reduced by 20% or more by compensating for the degradation of focusing characteristics due to a low cathode spot cutoff voltage. Third, the above effects can be realized by adjusting the thickness of the control or screen electrode and the distance between the two electrodes, thereby improving productivity.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An electron gun for a multi-media monitor, the electron gun comprising:

a cathode;

a control electrode;

a screen electrode; and a plurality of focusing electrodes to focus and accelerate an electron beam, wherein:

an additional electrode is not disposed between the screen electrode and the plurality of focusing electrodes to affect the electron beam emitted by the cathode and having passed through the control electrode and the screen electrode, and the electron gun satisfies a condition that a value of β is greater than or equal to 0.222, where $\beta = T1/D$, T1 denotes a thickness of the control electrode, and D denotes a diameter of an electron beam aperture of the control electrode and wherein a cathode spot cutoff voltage applied to the cathode is in the range of 50–95V.

2. The electron gun of claim 1, wherein the value of β satisfies the condition that $0.222 \leqq \beta < 0.316$.

3. The electron gun of claim 1, wherein a minimum diameter of the electron beam aperture of the control electrode is in the range of 0.3–0.4 mm.

4. The electron gun of claim 1, wherein the cathode spot cutoff voltage applied to the cathode is in the range of 50–80 V.

5. The electron gun of claim 1, wherein a zero voltage is applied to the control electrode, and a voltage of 400–1000V is applied to the screen electrode.

6. The electron gun of claim 5, wherein a voltage of approximately 600V is applied to the screen electrode.

7. The electron gun of claim 1, wherein the value of β satisfies the condition that $0.233 \leqq \beta < 0.316$.

8. The electron gun of claim 1, wherein the value of β satisfies the condition that $0.25 \leqq \beta < 0.316$.

9. An electron gun used with a multi-media monitor, the electron gun comprising:

a cathode;

a control electrode;

a screen electrode; and a plurality of focusing electrodes to focus and accelerate an electron beam, wherein:

an additional electrode is not disposed between the screen electrode and the plurality of focusing electrodes to affect the electron beam emitted by the cathode and having passed through the control electrode and the screen electrode, the electron gun satisfies a condition that $0.222 \leqq \beta < 0.316$, where $\beta = T1/D$, T1 denotes a thickness of the control electrode, and D denotes a diameter of an electron beam aperture of the control electrode, and a zero voltage is applied to the control electrode, a voltage of approximately 600V is applied to the screen electrode, and a cathode spot cutoff voltage of 50–80V is applied to the cathode.

10. The electron gun of claim 9, wherein the value of β satisfies the condition that $0.233 \leqq \beta < 0.316$.

11. The electron gun of claim 9, wherein the value of β satisfies the condition that $0.25 \leqq \beta < 0.316$.

12. An electron gun for a multi-media monitor, the electron gun comprising:

a cathode;

a control electrode;

a screen electrode; and a plurality of focusing electrodes to focus and accelerate an electron beam, wherein the electron gun satisfies a condition that a value of β is greater than or equal to 0.233, where $\beta = T1/D$, T1 denotes a thickness of the control electrode, and D denotes a diameter of an electron beam aperture of the control electrode and a cathode spot cutoff voltage of 50–80V is applied to the cathode.

13. The electron gun of claim 12, wherein the value of β satisfies the condition that $0.233 \leqq \beta < 0.316$.

14. The electron gun of claim 12, wherein the value of β satisfies the condition that $0.25 \leqq \beta < 0.316$.

* * * * *